United States Patent [19]

Asick et al.

[11] Patent Number: 4,993,975

[45] Date of Patent: Feb. 19, 1991

[54] ELECTRICAL CONNECTOR AND TAPERED FIXED BEAM CONTACT THEREFOR

[75] Inventors: John C. Asick, Harrisburg; George H. Douty, Mifflintown; James S. Staron, Halifax; Thomas J. Zola, Harrisburg, all of Pa.

[73] Assignee: AMP Incorporated, Harrisburg, Pa.

[21] Appl. No.: 376,729

[22] Filed: Jul. 7, 1989

[51] Int. Cl.[5] ..... H01R 13/42

[52] U.S. Cl. ..... 439/751; 439/851; 439/78

[58] Field of Search ..... 439/851-858, 439/733, 741, 751, 78

[56] References Cited

U.S. PATENT DOCUMENTS

| | | | |
|---|---|---|---|
| 3,533,054 | 10/1970 | Spriggs et al. | 439/733 |
| 3,538,491 | 11/1970 | Longenecker et al. | 439/851 |
| 3,715,629 | 2/1973 | Swengel, Sr. . | |
| 3,761,871 | 9/1973 | Teurlings | 439/751 |
| 4,448,477 | 5/1984 | Gladd et al. | 439/851 |
| 4,687,278 | 8/1987 | Grabbe et al. . | |
| 4,721,484 | 1/1988 | Sakamoto et al. . | |
| 4,775,336 | 10/1988 | Paulo | 439/733 |

FOREIGN PATENT DOCUMENTS

| | | | |
|---|---|---|---|
| 8807774 | 10/1988 | PCT Int'l Appl. | 439/851 |
| 2054281 | 2/1981 | United Kingdom | 439/851 |

*Primary Examiner*—David L. Pirlot

*Attorney, Agent, or Firm*—David L. Smith

[57] ABSTRACT

A receptacle contact (22) adapted to be received in a connector housing (26), or a connector housing (26) having the receptacle contact (22) received therein, wherein the receptacle contact (22) is a three sided contact forming a U-shaped channel (68) for receiving a contact element (46). The contact (22) comprises a pair of tapered fixed beams (64,66) at least portions of which are curved inwardly toward each other with a smooth continuous curvature to a spacing at least less than the diameter or cross section width of a contact element (46) to be received therebetween. The tapered fixed beams (64,66) taper from forward and trailing ends (70,72) toward a midpoint (74). The contact (22) may have a center rib (96) integral with and extending between the bases (86,94) that are integral with the ends (70,72) of the fixed beams (64,66). The rib (96) includes retention means (98,102) for securing the contact in a contact receiving passage (32) of a connector housing (26). The retention means (98,102) cooperate with the walls (106,114) of the contact receiving passage (32) to secure the contact (22) to one side of the passage (32).

24 Claims, 7 Drawing Sheets

48
20
28
32
40
38
48
42
44
26
36
30
38
34
22
54
52
36
34
22
50
52
24
54
52
58
56
58
56
50

ELECTRICAL CONNECTOR AND TAPERED FIXED BEAM CONTACT THEREFOR

BACKGROUND OF THE INVENTION

This invention relates to electrical connectors and contacts therefor and in particular to a high density electrical connector and receptacle contact having a tapered fixed beam wherein the contact is adapted to be received and secured in the high density connector.

As printed circuit board components are downsized, the area on printed circuit boards allocated to connectors is also decreased. As the smaller area is utilized, the density of contacts in connectors is increased with restrictions also imposed on the height connectors extend above the printed circuit board on which they are mounted. The restriction in height minimizes the stacking height of connectors and thus minimizes the spacing between adjacent printed circuit boards.

There is disclosed in U.S. Pat. No. 3,715,629 a receptacle contact in which the base of a U-shaped channel section has been blanked out at a plurality of points along its length so as to leave in the sidewalls only opposed pairs of bridging straps which are bowed with a smooth continuous curvature inwardly towards each other to a spacing at least less than a thickness of a blade to be received therebetween.

SUMMARY OF THE INVENTION

In accordance with the present invention, there is disclosed a receptacle contact adapted to be received in a connector housing, or a connector housing having the receptacle contact received therein, wherein the receptacle contact is a three sided contact forming a U-shaped channel for receiving a contact element. The contact comprises a pair of tapered fixed beams at least portions of which are curved inwardly toward each other with a smooth continuous curvature to a spacing at least less than the diameter or cross section width of a contact element to be received therebetween. The tapered fixed beams taper from forward and trailing ends toward a midpoint. The contact may have a center rib integral with and extending between the supports that are integral with the ends of the fixed beams. The rib includes retention means for securing the contact in a contact receiving passage of a connector housing. The retention means cooperate with the walls of the contact receiving passage to secure the contact to one side of the passage.

DESCRIPTION OF THE PREFERRED EMBODIMENT

Figure 1:
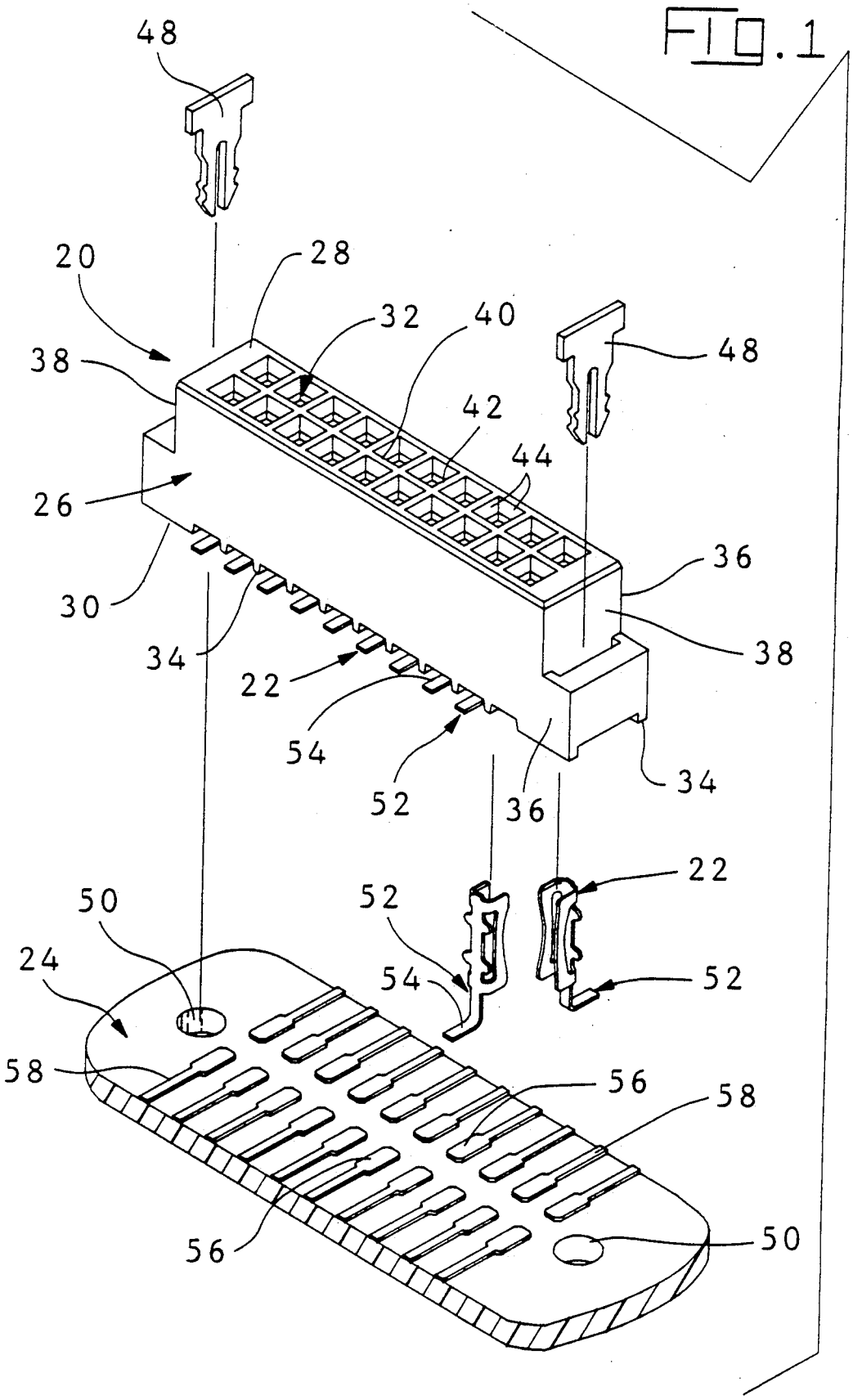
FIG. 1 is a perspective view of an electrical connector positioned above a printed circuit board with a pair of surface mount receptacle contacts in accordance with the invention exploded therefrom.
Figure 5:
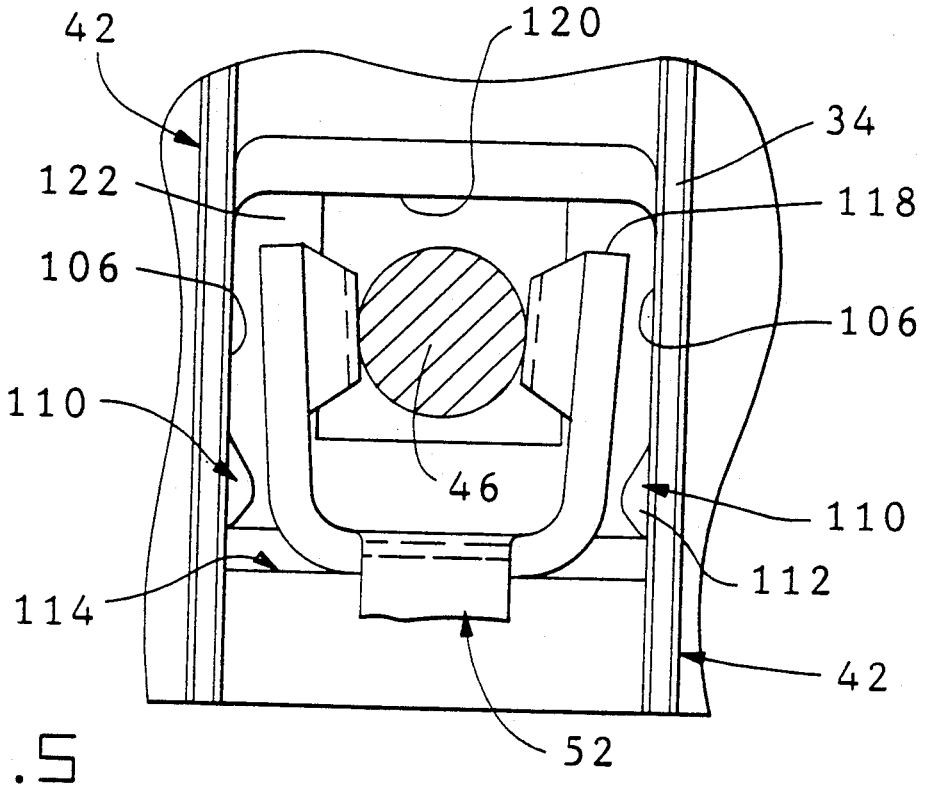
FIG. 5 is a mounting face view of a typical receptacle contact with a pin contact received therein.

An electrical connector 20 having receptacle contacts 22 in accordance with the present invention is shown in FIG. 1, exploded from printed circuit board 24. Connector 20 includes housing 26 molded of a suitable dielectric material, having forward mating face 28, and opposed mounting face 30, and contact receiving passages 32 extending therebetween with contacts 22 received and secured therein. Mounting face 30 may have standoffs 34 to accommodate cleaning subsequent to soldering. Standoffs 34 may be tapered, inter alia, to facilitate insertion of contacts 22 and passages 32. Housing 26 has side walls 36 and end walls 38 with two rows of contact receiving passages between end walls 38. The invention is not limited to a two row housing, alternatively the housing may have only one roW or more than two rows of contact receiving passages. The rows of contact receiving passages 32 are separated from each other by barrier wall 40. The passages 32 in each row are separated from one another by transverse partitions 42. Each contact receiving passage 32 opens onto mating face 28 with contact receiving passage 32 having a tapered inlet 44 to facilitate alignment and reception of a male electrical contact element 46, one of which is shown in FIG. 5, into contact receiving passage 32. Contact element 46 while shown as a round post may take other forms such as a square post. Connector 20 typically has a pair of spaced board locks 48 to secure the connector to board 24 temporarily upon stuffing by reception of board lock 48 in spaced apertures 50, and more permanently upon soldering.

Figure 6:
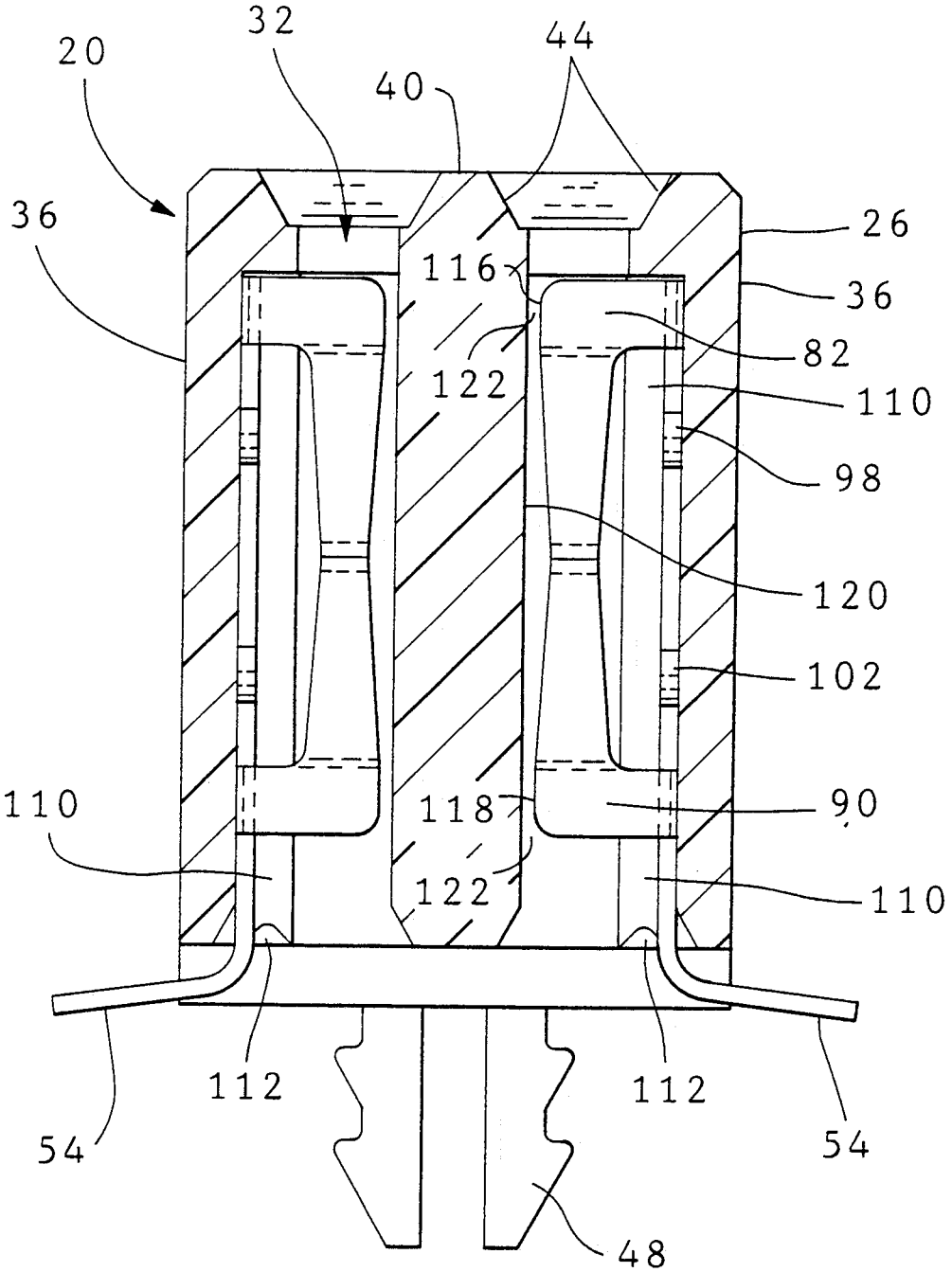
FIG. 6 is an end cross sectional view of a connector housing showing receptacle contacts received in passageways therein.
Figure 7:
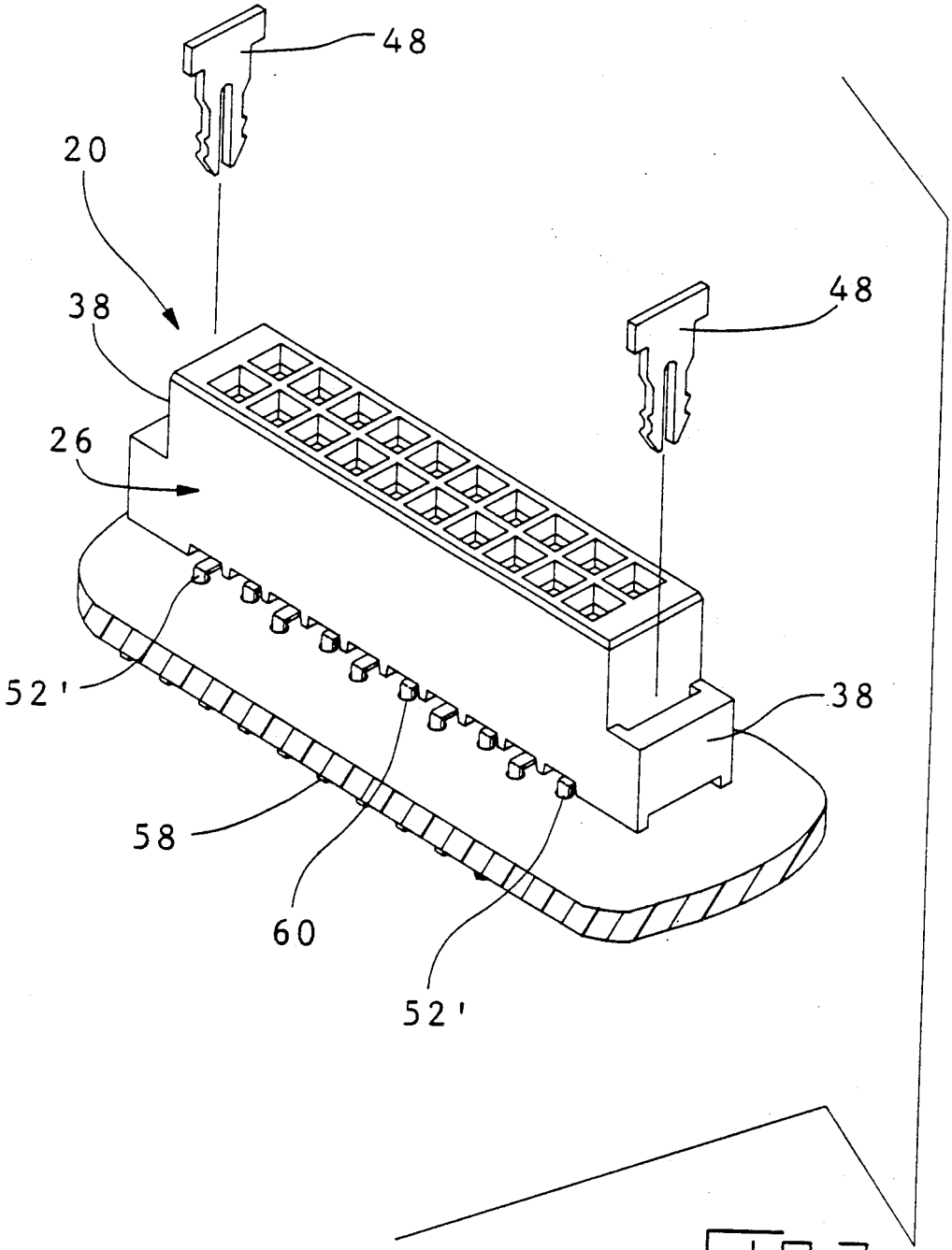
FIG. 7 is a perspective view of an electrical connector mounted on a printed circuit board with alternate embodiment receptacle contacts therein.

Contacts 22 have a solder tail 52 extending therefrom that is adapted to be engaged with circuits on board 24. As shown in FIG. 1, solder tail 52 is adapted for surface mounting connector 20 with the transverse portion 54 formed substantially perpendicular to the axis of contacts 22. Transverse portions 54 engage a corresponding array of pads 56 interconnected with traces 58 on board 24 upon mounting thereto. As best seen in FIG. 6, transverse portions 52 provide compliance upon mounting connector 20 on board 24. Solder tail 52 may take other forms. An alternate embodiment solder tail 52' is shown in FIG. 7 for through hole mount applications. In the alternate embodiment, solder tails 52' are formed into an array corresponding to an array of plated through holes 60 that are interconnected with traces 58. Pads 56 or through holes 60 may be staggered to obviate the need for fine trace technology and permit running traces between adjacent pads or through holes. Solder tails 52 and 52' are soldered (not shown) to pads 56 and plated through holes 60, respectively, to mechanically and electrically interconnect contacts 22 thereto.

Figure 2:
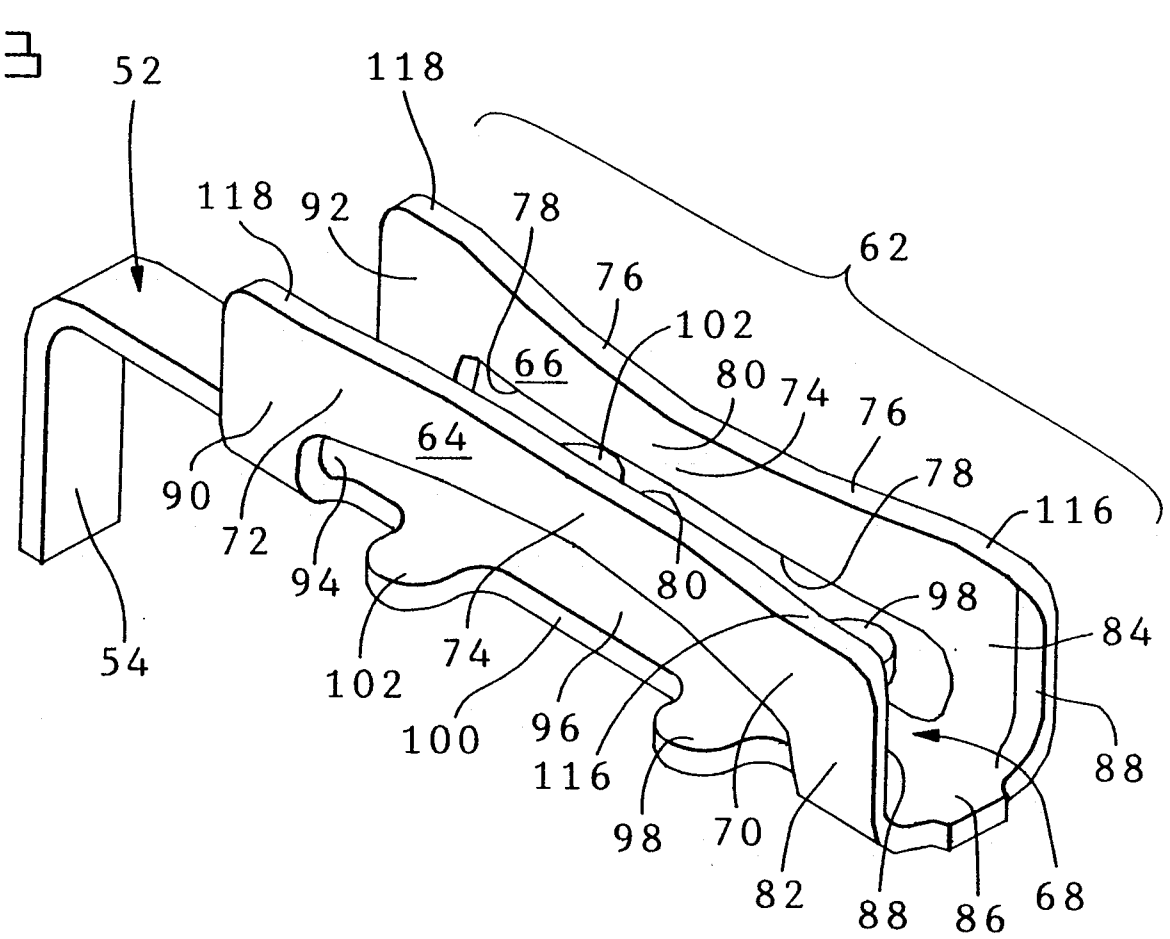
FIG. 2 is an enlarged perspective view of a receptacle contact shown in FIG. 1.
Figure 3:
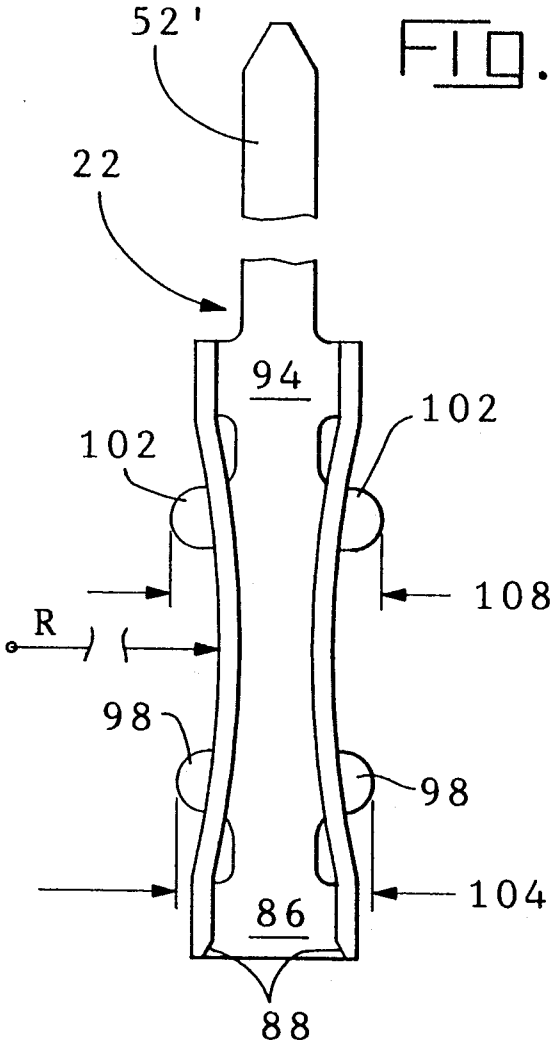
FIG. 3 is a top view of a formed receptacle contact.
Figure 8:
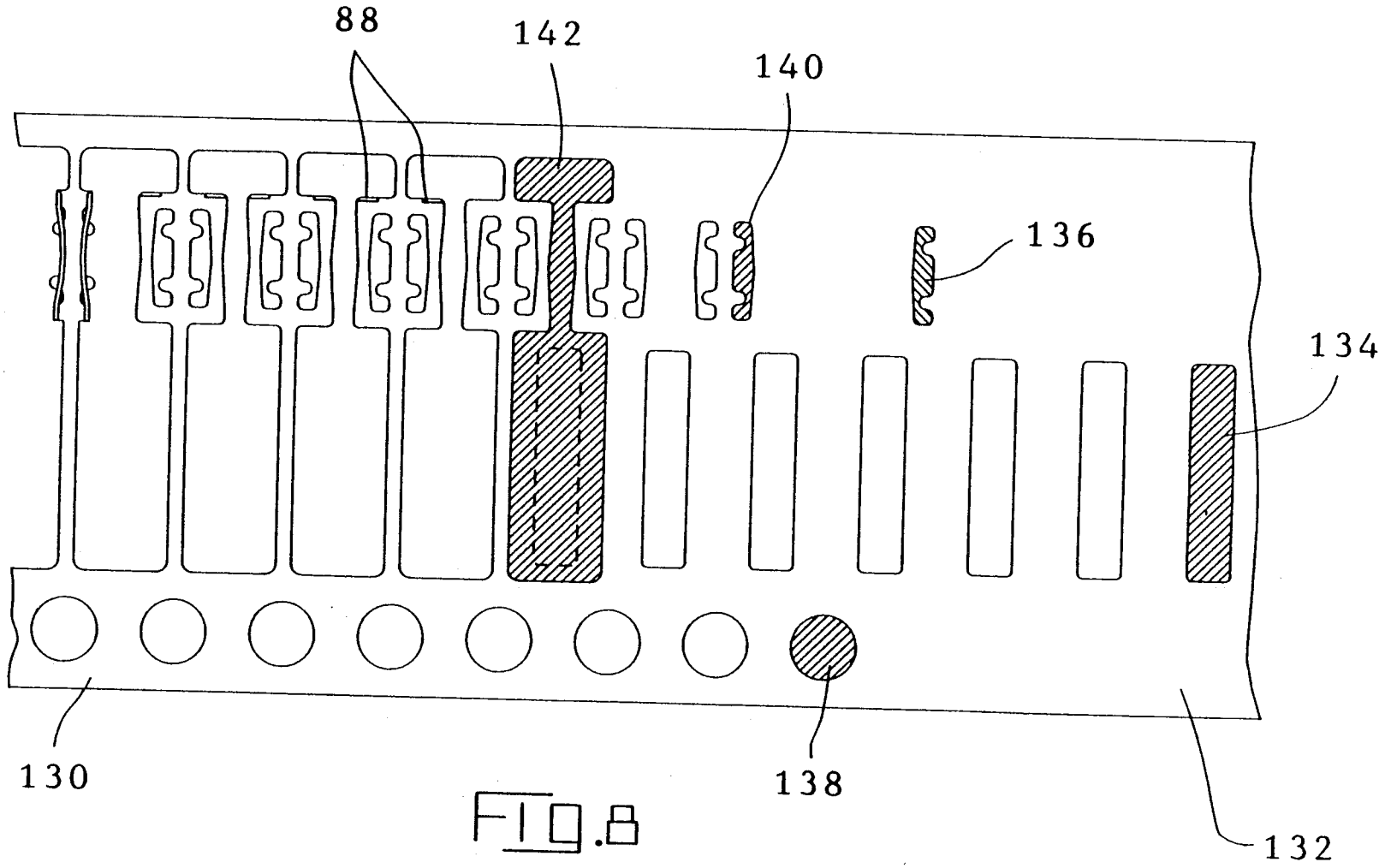
FIG. 8 is a progression of the various stages of stamping and forming of a contact from strip stock in accordance with the present invention.

As best seen with reference to FIGS. 2, 3 and 8, the receptacle portion 62 of contact 22 is a three sided contact forming a U-shaped channel therein for reception of contact element 46. Receptacle portion 62 comprises a pair of tapered fixed beams 64,66 at least portions of which are curved inwardly toward each other with a smooth continuous curvature (see FIG. 3) to a spacing at least less than the diameter or cross section width of a contact element 46 to be received in channel 68 defined therebetween. Tapered fixed beams 64,66 taper from forward end 70 and trailing end 72 toward a mid point 74. In a preferred embodiment, both outer edge 76 and inner edge 78 taper. The inner side surfaces 80 provide convex surfaces, due to the inward curvature of beams 64,66, that engage a contact element 46 received in channel 68. In this manner, side surfaces 80 provide multiple wiping surfaces that resiliently press against opposed sides of a contact element 46 received therebetween. In a preferred embodiment, the inward curvature of beam 64,66 is formed as a large radius, R, as best seen in FIG. 3. The greater the radius the higher the durability of contact 22. In a preferred embodiment the radius is about 2 to 3 times the length of beams 64,66.

Beam 64 at forward end 70 is integral with forward upstanding support 82; beam 66 at forward end 70 is integral with forward upstanding support 84. Supports 82 and 84 are integral with and extend upwardly from forward lateral edges of base 86, forming substantially a right angle therewith. The leading edges of supports 82,84 may be coined as at 88 to facilitate reception of a contact element 46 thereby minimizing the possibility of stubbing. Similarly, beam 64 at trailing end 72 is integral with trailing upstanding support 90; beam 66 at trailing end 72 is integral with trailing upstanding support 92. Supports 90 and 92 are integral with and extend upwardly from lateral edges of trailing base 94, forming substantially a right angle therewith. Solder tail 52 also extends from trailing base 94 generally so as not to interfere with the reception of a contact element 46 in channel 68.

A low, relatively uniform insertion force is required to insert a contact element 46 into channel 68 between beams 64,66. Upon insertion of a contact element 46 into channel 68, tapered fixed beams 64,66 are cammed apart with each beam partially flattened by the normal force developed between beam 64,66 and contact element 46. Contact element 46 engages both beams 64 and 66 providing redundant engagement therewith and hence enhanced reliability. Since beams 64,66 are fixed at both ends, and therefore somewhat rigid, the channel is forced to open to a limited degree to receive a contact element 46. The normal force is partially transferred through beams 64,66 to supports 82,84 at the forward end and to supports 90,92 at the trailing end, which causes supports 82,84 and 90,92 to flex outwardly as shown in FIG. 5 when compared to FIG. 4. In this manner, the receptacle portion 62 of contact 22 employs beams 64,66, supports 82,84, 92 and 94, as well as bases 86 and 94 to provide the normal force reaction on contact element 46.

Figure 9:
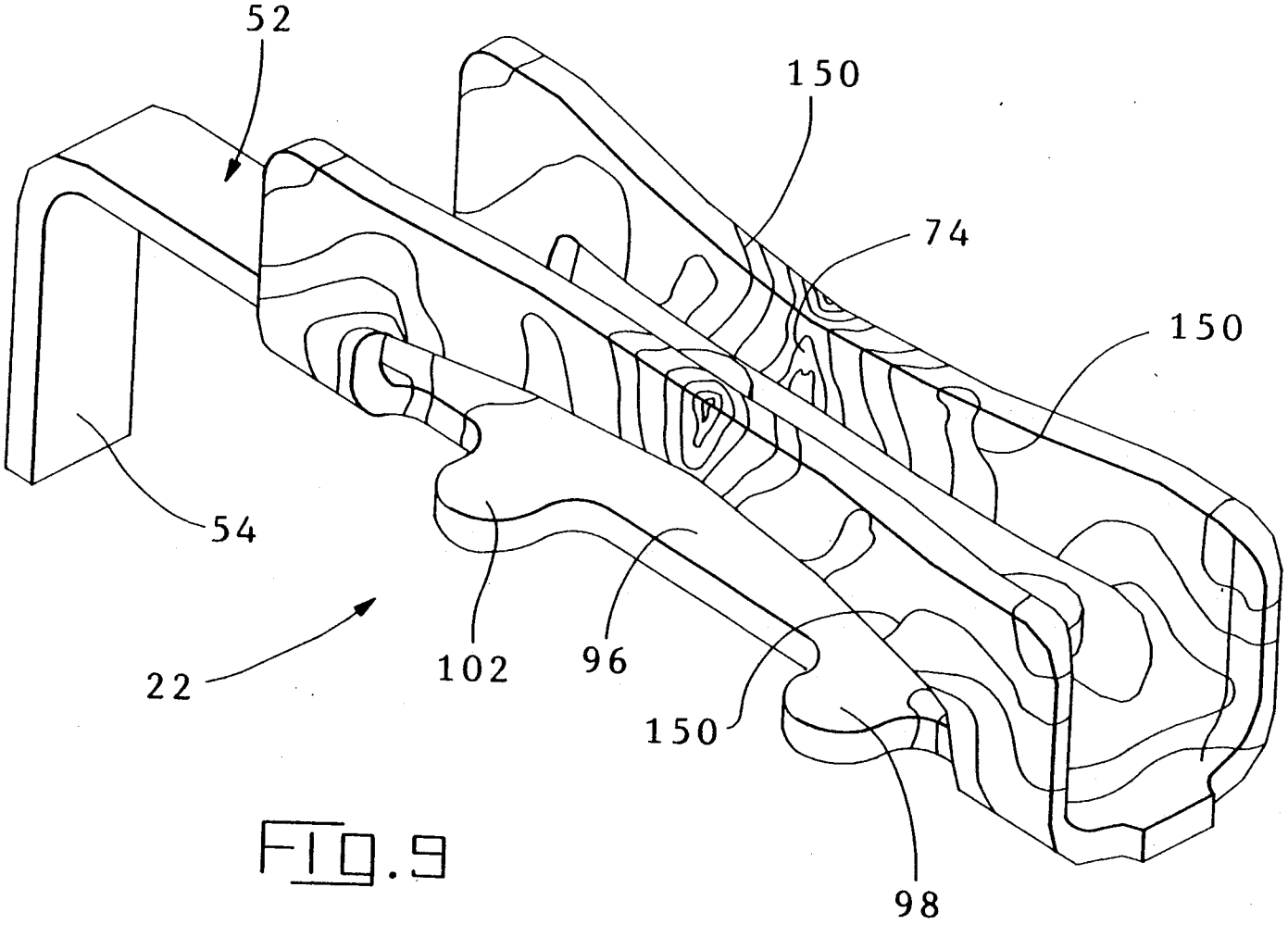
FIG. 9 is a contact with contour lines showing the substantially uniformly distributed stress throughout the length of the tapered fixed beam.

Beams 64,66 taper in cross-section from ends 70,72 toward midpoint 74 to provide more flexure with the resultant advantage that the tapered beamed structure provides a substantially uniform distributed stress throughout the length of beams 64,66 as shown in FIG. 9. In FIG. 9, the contour lines 150 represent changes in levels of stress in contact 22 with a contact element 46 (not shown in FIG. 9) received in channel 68. While beams 64,66 are shown of uniform thickness and tapered height, the invention is not limited thereto. The beams could have uniform height and be tapered in thickness from ends 70,72 to midpoint 74. The more uniform stress distribution is important as contacts are made smaller to minimize the likelihood of contact failure.

Figure 4:
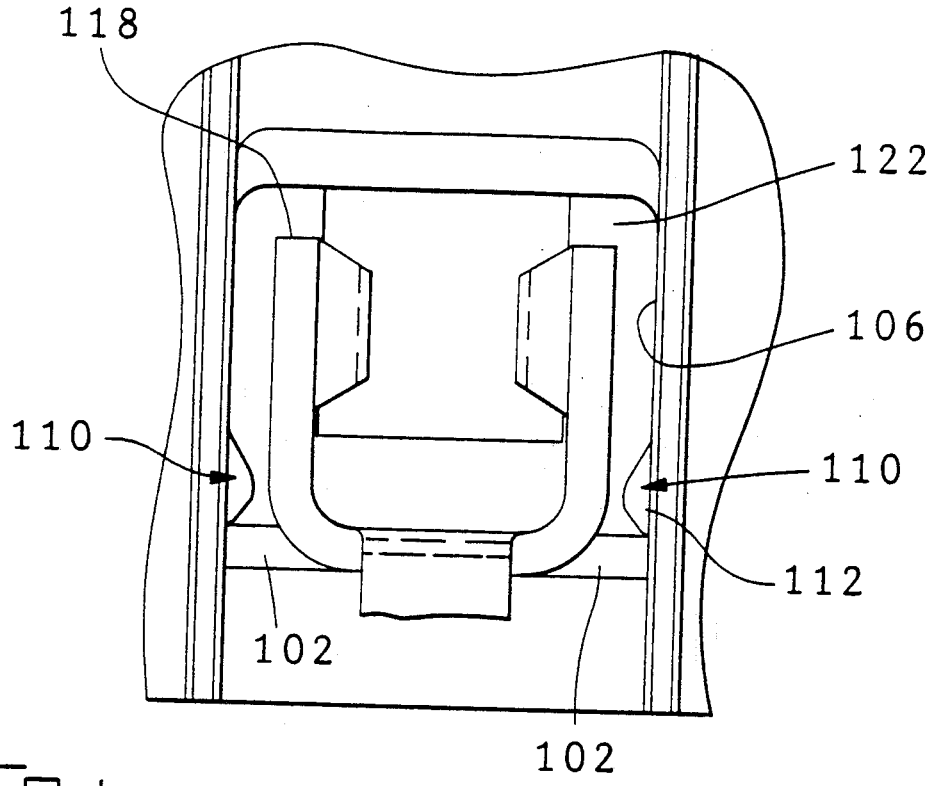
FIG. 4 is a mounting face view of a typical receptacle contact received in a passageway.

Contact 22 may have a rib 96 integral with and extending between bases 86 and 94. Rib 96 imparts strength to contact 22 to withstand insertion forces, provides structure on which retention means are provided, and forms a floor for channel 68. Retention tabs 98 extend from lateral edges 100 of rib 96 proximate base 86 and retention tabs 102 extend from lateral edges 100 of rib 96 proximate base 94. The insertion force to insert contact 22 into passage 32 is transmitted through rib 98 to overcome the resistance to insertion encountered by tabs 98 and 102. The tip-to-tip dimension 104 (FIG. 3) of retention tabs 98 is large enough to provide an interference fit with side walls 106 (FIGS. 4 and 5). The tip-to-tip dimension 108 of retention tabs 102 is slightly greater than dimension 104 such that retention tabs 98, upon insertion of contact 22 into a passage 32, plough through housing material forming side wall 106 providing an interference fit therewith, and retention tabs 102 follow retention tabs 98 upon insertion and plough through housing material forming sidewall 106 that was undisturbed by retention tabs 98, to secure contact 22 and passage 32.

Placing retention tabs 98 and 102 along rib 96 provides retention means for contact 22 within the length of receptacle portion 62 which minimizes the length of contact 22 and concomitantly minimizes the stacking height of connector 20, in which contacts 22 are secured, and a mating connector (not shown). Alternatively, contact 22 may have retention means outside the length of receptacle portion 62. Tabs 98 and 102 also align channel 68 with the tapered opening into passage 32 on mating face 28.

As shown in a typical contact receiving passage in FIGS. 4 and 5, side walls 106 are the inner surfaces of transverse partitions 42, but could function equally as the inner surfaces of barrier wall 40 and side wall 36 with an appropriately-oriented solder tail 52. Ribs 110 formed on side walls 106 have a tapered end 112 and extend into passages 32. Ribs 110 are spaced from side wall 114 of passage 32 substantially the thickness of tabs 98 and 102, such that upon insertion of contact 22 in passage 32, contact 22 is positioned at a known location against side wall 114 in each passage 32. Tabs 98 and 102 are received between ribs 110 and side wall 114; tabs 98 and 102 may provide an interference with ribs 110. By positioning and securing contact 22 against side wall 114, it is assured that distal ends 116 of forward upstanding supports 82,84 and distal ends 118 of trailing upstanding supports 90,92 are free to move, that is they do not engage side wall 120. Space 122 is maintained between distal ends 116,118 and side wall 120 to assure supports 82,84,96 and 98 are not prevented from flexing upon insertion of contact 46 into channel 68.

As best seen in FIGS. 4 and 5, upon insertion of a contact element 46 into channel 68, beams 64,66 are cammed apart with each beam partially floating and supports 82,84,90 and 92 flexing outwardly toward side walls 106. In normal operation, beams 64,66 and supports 82,84,90,92 do not engage side walls 106. Side walls 106 act as an anti-overstress for beams 64,66 and supports 82,84,90 and 92, with the beams or supports engaging side walls 106 if contact element 46 is bent or mis-aligned with passage 32. This feature is important in a connector housing in which the receptacle contact does not float or shift in position to accommodate misalignment or bent contacts.

FIG. 8 shows a right-to-left progression of the various stages of stamping and forming to make a contact 22 retained on a carrier strip 130 from strip stock 132. A blanking operation removes region 134. A subsequent blanking operation removes region 136 profiling tabs on one side of rib 96 and inner edge 78 of beam 66. Next, a feed hole 138 is blanked out. A region 140 is blanked out profiling the tabs on the other side of rib 96 and on the inner edge of beams 64. The final blanking operation removes region 142 forming the outer edge 76 of beam 64 of one contact and beam 66 of an adjacent contact, as well as the outer edges of supports 82,84,90 and 92 of beams 64,66 so formed. The leading edge of supports 82 and 84 are then coined at 88. The beams 64,66 are formed to curve from supports 82,84 toward mid-point 74. Supports 82,84,90,92 are formed substantially perpendicular to bases 86,94 to form contact 22. Contact 22 may be plated such as with gold in region 80 after being stamped and formed, or a strip of gold may be plated on strip stock 132 before contact 22 is stamped and formed therefrom.

We claim:

1. A receptacle contact adapted to be received in a contact receiving passage of a connector housing, comprising:

first and second base members;

a first support member, said first support member having a first end integral with the first base member and a second end formed normal thereto;

a second support member, said second support member having a first end integral with the second base member and a second end formed normal thereto;

a first tapered fixed beam, said first tapered fixed beam having a first end integral with the second end of the first support member and a second end integral with the second end of the second support member, said beam tapering to narrow from proximate the second end of each of said first and second support members to a midpoint, said beam formed inwardly toward an axis of the contact between said first and second support members; and a central rib extending between and integral with the first and second base members, said central rib having a first pair of interference protrusions at a first location along the central rib, the first pair of interference protrusions defining a predetermined tip-to-tip distance adapted to engage side walls of a contact receiving passage upon insertion of the contact into a contact receiving passage, said central rib having a second pair of interference protrusions spaced along said central rib from said first pair of interference protrusions, said second pair of interference protrusions defining a tip-to-tip distance that is greater than the predetermined tip-to-tip distance of said first pair of interference protrusions.

2. A receptacle contact as recited in claim 1, further comprising a solder tail integral with and extending from said first base member.

3. A receptacle contact as recited in claim 2, wherein the solder tail is adapted for surface mount applications.

4. A receptacle contact as recited in claim 2, wherein the solder tail is adapted for through hole mount applications.

5. A receptacle contact as recited in claim 1, further comprising:

a third support member having a first end integral with the first base member and a second end formed normal thereto;

a fourth support member having a first end integral with the second base member and a second end formed normal thereto;

a second beam, said second beam having a first end integral with the second end of the third support member and a second end integral with the second end of the fourth support member, said second beam tapering to narrow from proximate the second end of each of said third and fourth support members to a midpoint.

6. A receptacle contact as recited in claim 5, wherein said second beam forms an inward arcuate curvature toward said first beam between said first and second support members.

7. An electrical connector, comprising:

a dielectric housing having contact receiving passages therein, said contact receiving passages extending from a mating face to a rear face and defining opposed side walls, and a reference side wall, said opposed side walls having means that cooperate with a contact received in the passage for retaining the contact against said reference side wall;

a contact adapted to be received in at least one of said contact receiving passages, said contact comprising first and second base members;

a first support member, said first support member having a first end integral with the first base member and a second end formed normal thereto;

a second support member, said second support member having a first end integral with the second base member and a second end formed normal thereto;

a first tapered fixed beam, said first tapered fixed beam having a first end integral with the second end of the first support member and a second end integral with the second end of the second support member, said beam tapering to narrow from proximate the second end of each of said first and second support members to a midpoint, said beam formed inwardly toward an axis of the contact between said first and second support members; and a central rib extending between and integral with the first and second base members, said central rib having a first pair of interference protrusions at a first location along the central rib, the first pair of interference protrusions defining a predetermined tip-to-tip distance adapted to engage side walls of a contact receiving passage upon insertion of the contact into a contact receiving passage, said central rib having a second pair of interference protrusions spaced along said central rib from said first pair of interference protrusions, said second pair of interference protrusions defining a tip-to-tip distance that is greater than the predetermined tip-to-tip distance of said first pair of interference protrusions.

8. An electrical connector as recited in claim 7, wherein the contact further comprises a solder tail integral with and extending from said first base member.

9. An electrical connector as recited in claim 8, wherein the solder tail is adapted for surface mount applications.

10. An electrical connector as recited in claim 8, wherein the solder tail is adapted for through hole mount applications.

11. An electrical connector as recited in claim 7, wherein the contact further comprises:

a third support member having a first end integral with the first base member and a second end formed normal thereto;

a fourth support member having a first end integral with the second base member and a second end formed normal thereto;

a second beam, said second beam having a first end integral with the second end of the third support member and a second end integral with the second end of the fourth support member, said second beam tapering to narrow from proximate the second end of each of said third and fourth support members to a midpoint.

12. An electrical connector as recited in claim 11, wherein said second beam forms an inward arcuate curvature toward said first beam between said first and second support members.

13. An electrical connector, comprising:

a dielectric housing having contact receiving passages therein, said contact receiving passages extending from a mating face to a rear face and defining opposed side walls, a reference side wall and a free side wall;

a contact received in at least one of said contact receiving passages, said contact comprising first and second base members engaging said reference side wall;

a first support member, said first support member having a first end integral with the first base member and a second end defining a first distal edge, said second end formed to extend toward said free side wall, said first distal edge spaced from said free side wall, a second support member, said second support member having a first end integral with the second base member and a second end defining a second distal edge, said second end formed to extend toward said free side wall, said second distal edge spaced from said free side wall;

a first tapered fixed beam, said first tapered fixed beam having a first end integral with the second end of the first support member and a second end integral with the second end of the second support member, said beam tapering to narrow from proximate the second end of each of said first and second support members to a midpoint, said beam formed inwardly toward an axis of the contact between said first and said second support members; and means for securing said contact in said passageway with said base members engaging said reference side wall, whereby upon insertion of a pin into the contact, the tapered fixed beam cams outwardly and the support members flex outwardly without the distal edges engaging the free side wall of the contact receiving passage.

14. An electrical connector as recited in claim 13, further comprising means on said opposed side walls that cooperate with the contact for retaining the contact against said reference side wall.

15. An electrical connector as recited in claim 13, wherein the contact further comprises a central rib extending between and integral with the first and second base members.

16. An electrical connector as recited in claim 15 wherein the central rib further comprises means for securing the contact against said reference side wall.

17. An electrical connector as recited in claim 16, wherein the securing means comprises a first pair of interference protrusions at a first location along the central rib, the first pair of interference protrusions defining a predetermined tip-to-tip distance adapted to engage said opposed side walls in an interference fit.

18. An electrical connector as recited in claim 17, wherein the securing means further comprises a second pair of interference protrusions, said second pair of interference protrusions spaced along said central rib from said first pair of interference protrusions, said second pair of interference protrusions defining a tip-to-tip distance that is greater than the tip-to-tip distance of said first pair of interference protrusions.

19. An electrical connector as recited in claim 17, further comprising means on said opposed side walls that cooperate with said first pair of interference protrusions for retaining the contact against said reference side wall.

20. An electrical connector as recited in claim 13, wherein the contact further comprises an solder tail integral with and extending from said first base member.

21. An electrical connector as recited in claim 20, wherein the solder tail is adapted for surface mount applications.

22. An electrical connector as recited in claim 20, wherein the solder tail is adapted for through hole mount applications.

23. An electrical connector as recited in claim 13, wherein the contact further comprises:

a third support member having a first end integral with the first base member and a second end defining a third distal edge, said second end formed to extend toward said free side wall, said third distal edge spaced from said free side wall;

a fourth support member having a first end integral with the second base member and a second end defining a fourth distal edge, said second end formed to extend toward said free side wall, said fourth distal edge spaced from said free side wall;

a second beam, said second beam having a first end integral with the second end of the third support member and a second end integral with the second end of the fourth support member, said second beam tapering to narrow from proximate the second end of each of said third and fourth support members to a midpoint.

24. An electrical connector as recited in claim 23, wherein said second beam forms an inward arcuate curvature toward said first beam between said third and fourth support members.

* * * * *